United States Patent [19]

Sarnezki

[11] 4,000,438

[45] Dec. 28, 1976

[54] ELECTRON BEAM COLLECTOR FOR TRANSIT TIME TUBES, IN PARTICULAR MEDIUM POWER TRAVELING WAVE TUBES AND A PROCESS FOR PRODUCING SAME

[75] Inventor: Herbert Sarnezki, Munich, Germany

[73] Assignee: Siemens Aktiengesellschaft, Berlin & Munich, Germany

[22] Filed: Sept. 22, 1975

[21] Appl. No.: 615,404

[30] Foreign Application Priority Data

Oct. 17, 1974 Germany ..... 2449506

[52] U.S. Cl. ..... 315/3.5; 313/30; 313/41; 315/5.38

[51] Int. Cl.[2] ..... H01J 25/34

[58] Field of Search ..... 315/3.5, 5.38, 5.39, 315/5.34; 313/30, 41

[56] References Cited

UNITED STATES PATENTS

| | | | |
|---|---|---|---|
| 3,127,538 | 3/1964 | Dench | 315/3.5 |
| 3,225,269 | 12/1965 | Worcester | 315/3.5 |
| 3,444,418 | 5/1969 | Sarnezki | 315/3.5 |
| 3,538,367 | 11/1970 | Sarnezki | 315/3.5 |
| 3,549,930 | 12/1970 | Katz | 315/5.38 |
| 3,593,059 | 7/1931 | Sarnezki | 315/3.5 |

FOREIGN PATENTS OR APPLICATIONS

| | | | |
|---|---|---|---|
| 1,766,364 | 5/1971 | Germany | 315/5.38 |

*Primary Examiner*—Saxfield Chatmon, Jr.
*Attorney, Agent, or Firm*—Hill, Gross, Simpson, Van Santen, Steadman, Chiara & Simpson

[57] ABSTRACT

An electron beam collector for transit time tubes, in particular medium power traveling wave tubes, is electrically insulated from a housing by an intermediate layer which comprises a high-voltage resistant, temperature resistant, flexible synthetic resin sheet which is metallized on both surfaces thereof. The intermediate layer, which is not closed upon itself, encloses the electron beam collector and has edge zones which project along a surface line of the collector and which extend radially outwardly, and against each other, to form a flange. The housing includes a recess which accommodates the flange, the housing including two parts which are secured together to clamp the layer between the collector and the housing in a firm clamped fit.

12 Claims, 3 Drawing Figures

ELECTRON BEAM COLLECTOR FOR TRANSIT TIME TUBES, IN PARTICULAR MEDIUM POWER TRAVELING WAVE TUBES AND A PROCESS FOR PRODUCING SAME

BACKGROUND OF THE INVENTION

1. Field of the Invention

This invention relates to an electron beam collector for transit time tubes, in particular medium power traveling wave tubes, which collector is electrically insulated from a housing by which it is surrounded by means of an intermediate layer which is metallized on its inner and outer surfaces and which includes a high-voltage resistant, temperature resistant and flexible synthetic resin material.

2. Description of the Prior Art

A collector constructed in the manner generally set forth above has been disclosed in the German allowed published applicatin No. 1,766,364, which corresponds to the British patent specification No. 1,246,205, in which the intermediate layer is in the form of a tube-shaped collector insulator and preferably consist of a multi-component epoxide resin.

It has been further proven that an insulator tube, if it is to fulfill its function satisfactorily in every situation and, in particular, is to form a good heat bridge, must be processed with particular dimensional accuracy (repeated borings) and demands an accurate distance between the collector and the housing. If it were desired to avoid these high production requirements by means of special application processes for the intermediate layer, for example by shrinking-on synthetic tubes, it would have to be accepted that at least the contact between the synthetic resin and the housing would remain unsatisfactory.

SUMMARY OF THE INVENTION

The primary object of the invention, therefore, is to avoid the disadvantages set forth above in respect of the structure and production of an electron beam collector for transit time tubes.

In order to avoid the above-described shortcomings, in a collector of the type described above, it is proposed, according to the present invention, that the intermediate layer, in the form of a foil which is not closed upon itself, encloses the collector and includes edge zones which project along a collector surface line and which are placed against one another (co-planar) to form a flange which is directed radially outwardly along the collector. Further, the housing contains a recess which accommodates the flange, and it is further proposed that the intermediate layer be provided with a permanent clamp fit.

Preferably, the housing comprises two longitudinal halves, therefore halves which can be visualized as being formed by a cut along a plane which contains the longitudinal axis of the collector, as this type of division of the housing allows the desired clamping fit to be achieved in a simple fashion by screwing the two housing halves to one another. In order to increase the heat discharge capacity, the housing itself is preferably in the form of a solid cooling body.

If the housing is to emit its heat loss mainly by way of one specific side of the housing, for example via the bottom side which is arranged on a base, it is advisable to arrange the edge zone flange opposite to such side. In this position, there is particularly little intervention of the flange into the heat transportation system.

The collector casing provided in accordance with the invention can by pressure—and without any fear of deformation—be transformed into a shape in which it completely fills the space between the collector and the housing and is in intimate contact with its partners over the whole of their contact surfaces. A clamp joint of this kind discharges the heat loss arising in the collector equally well over the entire surface and also particularly reliably prevents electrical arcing as the metallization—for example a copper lining—matches the surfaces which it contacts (rough areas and processing spikes on the housing and the collector are depressed into the soft metallization and no free spaces remain) and therefore potentials only exist between the extremely smooth inner surfaces of the two metallizations. Furthermore, these properties are not lost even when comparatively large dimensioning tolerances and low surface quality values are permitted for the collector components. The insulating layer itself can be kept very thin and is always easy to produce and facilitates an easy collector assembly.

In a further development of the invention, it is provided that the electrical supply to the collector be effected directly across the layer metallization. By a suitable shaping of the metal layers (form etching of the copper lining), the operating voltage can be conducted to the collector without any special collector terminal—a saving which is of particular significance in multi-stage collectors, thus in collectors having a plurality of electrodes which carry different potentials.

A collector constructed in accordance with the invention is preferably used in types of a tube in which the actual tube, together with guide magnets and the collector forms one unit and is assembled in a housing to form an assembly ("fully integrated tube").

BRIEF DESCRIPTION OF THE DRAWING

Other objects, features and advantages of the invention, its organization, construction and operation will be best understood from the following detailed description taken in conjunction with the accompanying drawing, on which.

DESCRIPTION OF THE PREFERRED EMBODIMENTS

Figure 1:
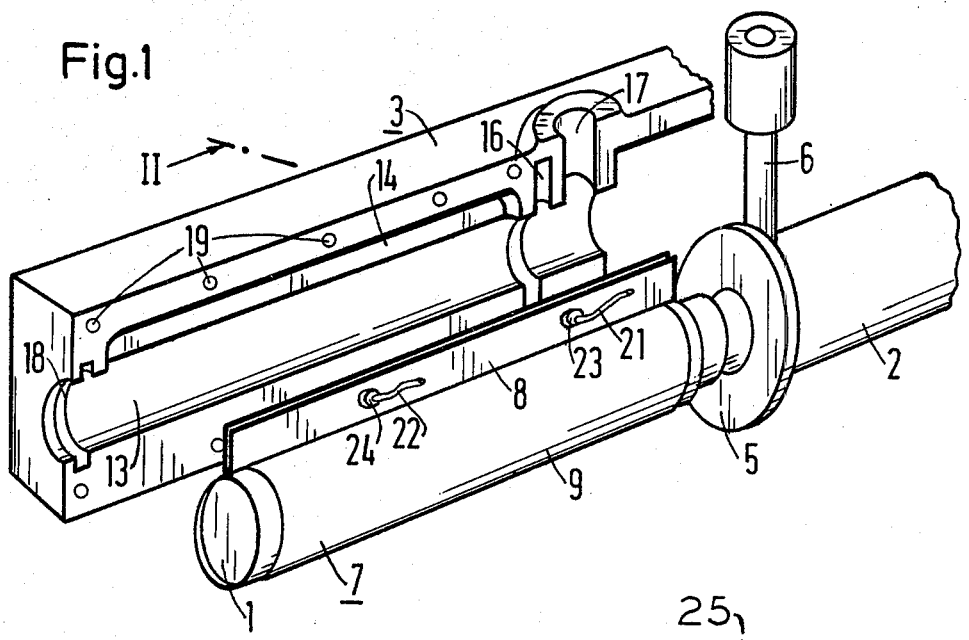
FIG. 1 is a partially broken away view illustrating the end of a tube which is provided with an electron beam collector constructed in accordance with the invention, and in which, for clarity, the front half of the housing has not been illustrated and the rear half of the housing has been shown in an exploded fashion spaced from the tube components.

Referring to the drawing, a traveling wave tube having a two-stage collector is illustrated which comprises a cylindrical electron beam collector 1, the actual tube 2 and a collector housing composed of two halves 3 and 4. The collector 1 and the tube 2 are structurally integrated via an insulating plate 5 to form a single unit: at the collector end of the tube an output coupling conductor 6 extends out of the housing.

Figure 2:
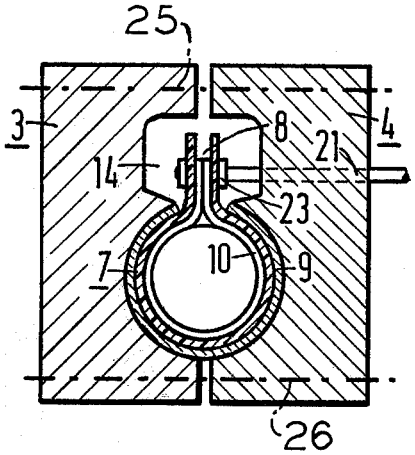
FIG. 2 is a sectional view taken substantially in the direction II illustrated in FIG. 1 showing both halves of the housing in place.

The collector itself is encased by a rectangular foil 7 which can, for example, comprise polyimide or Teflon. The two longitudinal edge zones of the foil 7 project and are brought together to form a flange 8 which extends outwardly, as illustrated in FIGS. 1 and 2.

Figure 3:
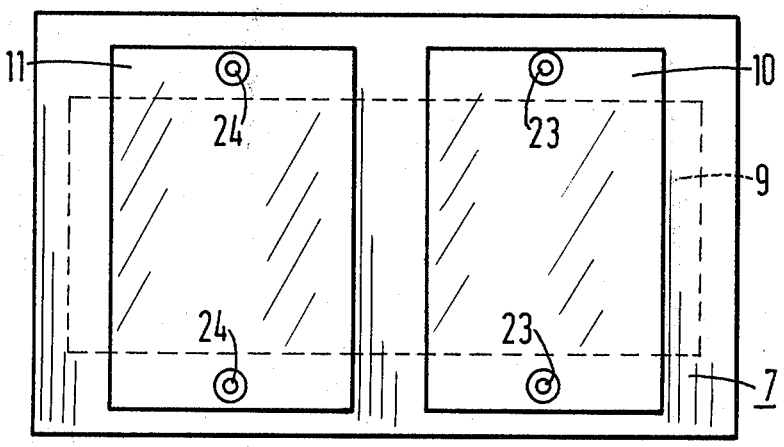
FIG. 3 is a plan view of a metallized insulating sheet, unrolled, which may be employed in practicing the embodiment of the invention illustrated in FIGS. 1 and 2.

Referring to FIG. 3, the outer surface of the foil 7 is provided with a metal layer 9 (outer metallization), and, in fact, with a copper lining, and the inner surface of the foil 7 bears another copper lining (inner metallization) in the form of two strips 10 and 11 which are spaced from each other. Each of the strips 10 and 11 contacts a respective one of the two collector electrodes which during the operation of the tube carry different potentials.

In the assembled state, the two housing halves 3 and 4, which are in the form of solid cooling bodies, span the collector 1, encased by the foil 7, and provide the foil 7 with a permanent clamp fit. It is seen in FIG. 1 that the two halves of the cooling body are provided for this purpose with a series of recesses: a collector recess 13, a flange recess 14, an insulating plate recess 16, a recess 17 for the output coupling hollow conductor 6, and a recess 18 for the collector base insulator (not illustrated). Also, bores 19 are introduced into the housing half 3 in order to be able to fix this half to the opposite half 4, as illustrated by the dash-dot broken lines 25 and 26 in FIG. 2 which represent screw connections.

The operating potentials for the individual collector electrodes are conducted to the latter directly across the stripshaped inner metal layers 10 and 11 without the use of terminals on the collectors. For this purpose, electrical supply lines 21 and 22 are directly soldered to the inner strips or layers 10 and 11 which contact the relevant electrodes, in soldering lugs 23 and 24 in the region of the edge zones which form the flange 8.

The collector described above can easily be assembled in the following manner: First of all, the foil 7, metallized on both sides (9, 10, 11), is wound around the collector 1, and the projecting edges of the foil 7 are formed into a flange 8 which is directed radially outwardly along a surface line of the collector 1. Then, the electrical supply conductors 21, 22 are soldered to the metal strips or layers 10 and 11 by soldering lugs 23 and 24, respectively, provided in the region of the foil flange 8. The unit obtained in this manner is then inserted into the two housing halves 3 and 4 and the latter are secured to one another, as by screw connections 25 and 26, until the desired clamp fit for the foil 7 is established.

Although I have described my invention by reference to a particular illustrative embodiment thereof, many changes and modifications of the invention may become apparent to those skilled in the art without departing from the spirit and scope of the invention. I therefore intend to include within the patent warranted hereon all such changes and modifications as may reasonably and properly be included within the scope of my contribution to the art.

I claim:

1. An electron beam collector arrangement for transit time tubes, in particular medium power traveling wave tubes, comprising:

an elongate collector including at least one conductive portion on its outer surface;

a high-voltage resistant, temperature resistant, flexible synthetic resin foil, at least one first metal layer carried on one side of said foil and a second metal layer carried on the other side of said foil, said foil enclosing said collector in a non-overlapping relation and including a pair of edge zones adjacent opposite edges thereof, said first metal layer contacting said conductive portion of said elongate collector and said edge zones projecting along a collector surface line and being placed one upon the other in a co-planar relation to form a flange which is directed radially outwardly along said collector; and a housing including a chamber shaped to receive said collector and said flange, said housing further including connectible mating housing sections for clamping said collector in said chamber with said second metal surface in continuous contact over its entire surface with the surface of said chamber.

2. The collector arrangement of claim 1, wherein said housing is a substantially solid cooling body.

3. The collector arrangement of claim 1, wherein said housing is divided into two housing sections along a plane which includes the longitudinal axis of said elongate collector.

4. The collector arrangement of claim 1, wherein one side of said housing is to constitute a primary heat discharge path and said edge zone flange is located opposite said one side.

5. The collector arrangement of claim 1, comprising: an electrical supply conductor extending through said housing and connected to said first metal layer.

6. The electron collector of claim 5, wherein said first metal layer extends into at least one of said edge zones, and said conductor is connected to said first metal layer in said one edge zone.

7. The collector arrangement of claim 1, comprising a beam tube connected to said collector, said housing adapted to receive and mount said tube and collector as an integrated unit.

8. The collector arrangement of claim 1, wherein said sheet comprises polyimide material.

9. The collector arrangement of claim 1, wherein said sheet comprises Teflon material.

10. The collector arrangement of claim 1, wherein said first and second metal layers comprise copper.

11. A multi-stage collector arrangement for transit time tubes, in particular medium power traveling wave tubes, comprising:

an elongate multi-stage collector including a separate conductive portion on the outer surface thereof for each collector stage;

a high voltage resistant, temperature resistant, flexible synthetic resin sheet, a plurality of first metal layers carried on one side of said sheet and a second metal layer carried on the opposite side of said sheet, said sheet including a pair of edge zones adjacent opposite edges thereof each of said first metal layers extending into an edge zone, said sheet embracing said multi-stage collector with said first metal layers contacting respective ones of said conductive portions and said edge zones extending radially outwardly to form a flange along said collector;

a plurality of electrical supply conductors connected to respective ones of said first metal layers in the extensions thereof into an edge zone;

a two-part housing, each part including a shaped recess which together with the like recess of the other part receives the sheet embraced elongate multi-stage colletor and projecting edge zone flange, said housing including holes for receiving said electrical supply conductors therethrough; and means for securing said housing parts together to clamp said sheet between said collector and said housing with the entire outer surface of said second metal layer in contact with the surface of said recesses.

12. A process for producing an electron beam collector arrangement, comprising the steps of:

wrapping an elongate collector to embrace the same with a flexible synthetic resin sheet which carries metal layers on both sides thereof;

forming an elongate radially outwardly directed flange from edge zones of the wrapped sheet;

attaching an electrical conductor to a metal layer of the sheet which contacts the collector;

inserting the wrapped collector into one half of a cooling body recessed to receive the wrapped and flanged collector;

placing a complementary shaped and recessed other half of the cooling body over the one half which is holding the wrapped and flanged collector; and securing the two body halves together to clamp the sheet firmly therebetween.

* * * * *